US006028947A

United States Patent [19]

Faraone et al.

[11] Patent Number: 6,028,947

[45] Date of Patent: Feb. 22, 2000

[54] LIGHTWEIGHT MOLDED WAVEGUIDE DEVICE WITH SUPPORT INFRASTRUCTURE

[75] Inventors: Alexander Faraone, Frenchtown; John W. Lemon, Maple Shade, both of N.J.

[73] Assignee: Single Source Technology and Development, Inc., Maple Shade, N.J.

[21] Appl. No.: 09/168,256

[22] Filed: Oct. 8, 1998

Related U.S. Application Data

[63] Continuation-in-part of application No. 08/966,639, Nov. 10, 1997.

[51] Int. Cl.[7] ..... H04R 25/00

[52] U.S. Cl. ..... 381/340; 381/337; 381/339; 181/152

[58] Field of Search ..... 381/337, 340, 381/339, 341, 342, 343; 181/152, 153, 159, 177, 179

[56] References Cited

U.S. PATENT DOCUMENTS

| | | | |
|---|---|---|---|
| 1,757,107 | 5/1930 | Baltzley | 181/164 |
| 1,787,946 | 1/1931 | La Rue | 381/152 |
| 4,013,846 | 3/1977 | Krawczak et al. | 179/115 |
| 4,178,473 | 12/1979 | Vermeren | 181/145 |
| 4,227,051 | 10/1980 | Thomas et al. | 181/144 |
| 4,300,655 | 11/1981 | Sakamoto et al. | 181/167 |
| 4,655,316 | 4/1987 | Murray | 181/164 |
| 4,811,403 | 3/1989 | Henrickson | 381/87 |
| 4,862,508 | 8/1989 | Lemon | 381/156 |
| 4,881,617 | 11/1989 | Faraone | 181/173 |

*Primary Examiner*—Sinh Tran
*Attorney, Agent, or Firm*—Kenneth P. Glynn, Esq.

[57] ABSTRACT

The present invention is a waveguide device having a body of molded, foam plastic with a speaker end and an open end and an even number of segments with a flat surface in a plane parallel to the speaker end. The segments have inside wall surfaces which flare increasingly outwardly from the speaker, and these inside wall surfaces have a speaker end length, $L_1$, determined by the following formulas, $L_1$ minimum=$0.7 \times w_s/0.0012$ g/cm$^3 \times 1/A_{SE}$, and $L_1$ maximum= $1.2 \times w_s/0.0012$ g/cm$^3 \times 1/A_{SE}$, wherein $L_1$ is a straight line length of the lower portion of the segment wall surface, $w_s$ is the weight of a speaker cone in grams/cm$^3$, and $A_{SE}$ is the cross-sectional area of the speaker end in square centimeters. The waveguide body also includes an end plate with a speaker face and anchor inserts for attachment of a speaker thereto. The anchoring inserts are embedded in the waveguide body.

20 Claims, 3 Drawing Sheets

LIGHTWEIGHT MOLDED WAVEGUIDE DEVICE WITH SUPPORT INFRASTRUCTURE

REFERENCE TO RELATED APPLICATION AND INCORPORATION BY REFERENCE

This patent application is a continuation-in-part of a pending U.S. patent application Ser. No. 08/966,639 and entitled "Radially Expanding Multiple Flat-Surfaced Waveguide Device" which was filed in the United States Patent and Trademark Office on Nov. 10, 1997 and is incorporated herein by reference.

BACKGROUND OF THE INVENTION

1. Field of the Invention

The present invention relates to waveguides and more particularly unique waveguide configurations utilizing a plurality of an even number of flat-surfaced segments which have unique geometric characteristics and may be constructed of light weight materials.

2. Information Disclosure Statement

Loudspeakers are well known and take the form of cones or horns. Conical loudspeakers have circular open ends and horns typically have rounded or straight edges such as rectangular open ends.

Early speaker designs are exemplified by U.S. Pat. No. 1,757,107 to Baltzley which teaches a sound generator, a tympanum having undulations extending from the central portion to the rim of the tympanum and gradually increasing in depth and width from such central portion outwardly toward the rim portion of the same and a connection for bodily vibrating said tympanum, said connection being rigidly engaged with an intermediate portion of the tympanum and supporting the tympanum for vibration in free air responsive to the movements of said connection.

U.S. Pat. No. 1,787,946 to LaRue wherein a suspended diaphragm is used. However, conventional acoustic speakers involved diaphragms of the aforesaid basic conical design wherein it radiated outwardly about a coil. Subsequent improvements led to the acoustic diaphragm having a honeycomb cone, e.g. of a plurality of laminated metal foils, the adjacent metal foils being adhered at a regular pitch.

U.S. Pat. No. 4,013,846 to Krawczak describes an electroacoustic loudspeaker having a rigid, lightweight diaphragm and a substantially closed loop magnet support of a magnetically permeable material having a channel-shaped cross-section and supported adjacent and spaced from the diaphragm with the open side of the channel facing the diaphragm. The magnet support carries a pair of magnets magnetized and positioned with opposite poles in spaced facing relation and a voice coil is secured to the diaphragm and lies in the gap between the magnets.

U.S. Pat. No. 4,300,655 to Sakamoto et al describes an acoustical diaphragm which is made of a cone member of elongated web material bent to have a plurality of radial projections sandwiched between upper and lower flat components. It is indicated by the invention therein that increased speaker power is achieved due to model line reshaping. While this patent is concerned with radial sound wave generation it is not directed to the type of system represented by the present invention wherein constant wave velocities are sought at high frequencies utilizing arcuated speaker segments which tend towards flattening as the radial distance increases.

U.S. Pat. No. 4,655,316 to Murray describes an acoustic diaphragm which is made of metallic sheet material forming a raised pattern of the material and unraised sectors of the material. The diaphragm is of the dome-shaped variety. The raised pattern incorporates sets of raised strip elements. There is a set of such elements extending radially from the vicinity of the apex. There is a set extending along areas of the sheet material between the radially extending elements, this second set including pairs of strip elements, this second set including pairs of strip elements which intersect one another along such areas. There is also a set of circumferentially extending raised strip elements. The form of the radially extending elements changes along their lengths; for example, they rise to levels which vary along their lengths.

U.S. Pat. No. 4,811,403 illustrates various types of horns for ultralight loudspeakers. This patent describes a loudspeaker and enclosure assembly which includes a load bearing member exhibiting good thermal conductivity; at least one loudspeaker mounted on the load bearing member and in thermal engagement therewith; and its enclosure having walls formed of rigid lightweight material mounted on the load bearing member to enclose the at least one loudspeaker, whereby the assembly is easily moved and mounted and thermal energy generated by operation of the loudspeaker is effectively dissipated through the load bearing member. The enclosure may be a rigid foam-filled member defining a generally funnel-shaped bore therein to form a horn for the loudspeaker, whereby a modular construction of interchangeable integrally formed enclosures and horns can be achieved. However, this patent does not show the type of arrangement or assembly specifically claimed herein.

U.S. Pat. No. 4,862,508 to Lemon describes an improved method for transmitting sound at high power levels over a wide angle zone of dispersion without distortion, comprising the step of emitted sound waves from a plurality of individual sources, each characterized by a relatively narrow, wedge-shaped envelope of sound projection, such that adjacent edges of respective sound projection envelopes are in substantial alignment and do not overlap, whereby the absence of interferences between sounds emitted from different sources precludes sound distortion and enables uniform sound dispersion and high sound quality throughout the zone. The sound waves are preferably emitted from electroacoustical loudspeakers having loudspeaker enclosures shaped to conform to the edges of their respective sound envelopes.

U.S. Pat. No. 4,881,617 to Alexander Faraone describes an acoustic speaker having a cone located about a transducer wherein the cone has a plurality a thin, pie-shaped segments radiating outwardly from the transducer with each of the segments having an arcuated cross-section, thereby creating a concave side and a convex side.

The above-described patent to Alexander Faraone, one of the inventers herein, is directed to cones having configurations which are concave towards the center whereas the present invention high frequency center cone has other unique and unobvious characteristics, including being convex towards it center, being unistructurally formed and being located about a voice coil support tube in a different manner.

Notwithstanding the prior art, the present invention is neither taught nor rendered obvious thereby.

SUMMARY OF THE INVENTION

The present invention is a waveguide device having a body with a speaker end and an open end and having a plurality of segments. The segments are substantially similar to one another, preferably identical, there being an even number of segments from four to twenty. Each of the segments have a flat surface in a plane parallel to the speaker end. The waveguide body also includes an end plate with a speaker face and anchor inserts for attachment of a speaker thereto. The anchoring inserts are embedded in the waveguide body. Each of the segments having inside wall surfaces which flare increasingly outwardly from the speaker, and wherein each of the segments' inside wall surfaces has a speaker end length, $L_1$, which is within the range determined by the following formulas:

$$L_1 \text{ minimum}=0.7\times w_s/0.0012 \text{ g/cm}^3\times 1/A_{SE}$$

and $$L_1 \text{ maximum}=1.2\times w_s/0.0012 \text{ g/cm}^3\times 1/A_{SE}$$

wherein $L_1$ is a straight line length of the lower portion of the segment wall surface, referred to as the speaker end length, $w_s$ is the weight of a speaker cone in grams/cm$^3$, and $A_{SE}$ is the cross-sectional area of the speaker end in square centimeters. Each of the segment inside wall surfaces has an outer end length $L_2$ wherein $L_2$ has a length within the range determined by the following formulas:

$$L_2 \text{ minimum}=0.7\times L_1$$

and $$L_2 \text{ maximum}=1.3\times L_1.$$

There is an angle between the straight line length of the lower portion of the segment wall surface and a center line running down the center of the length of the waveguide, referred to as ∠A, which is no greater than 15°. There is also a straight line length of the entire segment wall forming an angle with a center line running down the center of the length of the waveguide, referred to as ∠B, which is within the range determined by the following formulas:

$$\angle B \text{ minimum}=1.5\times\angle A$$

and $$\angle B \text{ maximum}=2.5\times\angle A.$$

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
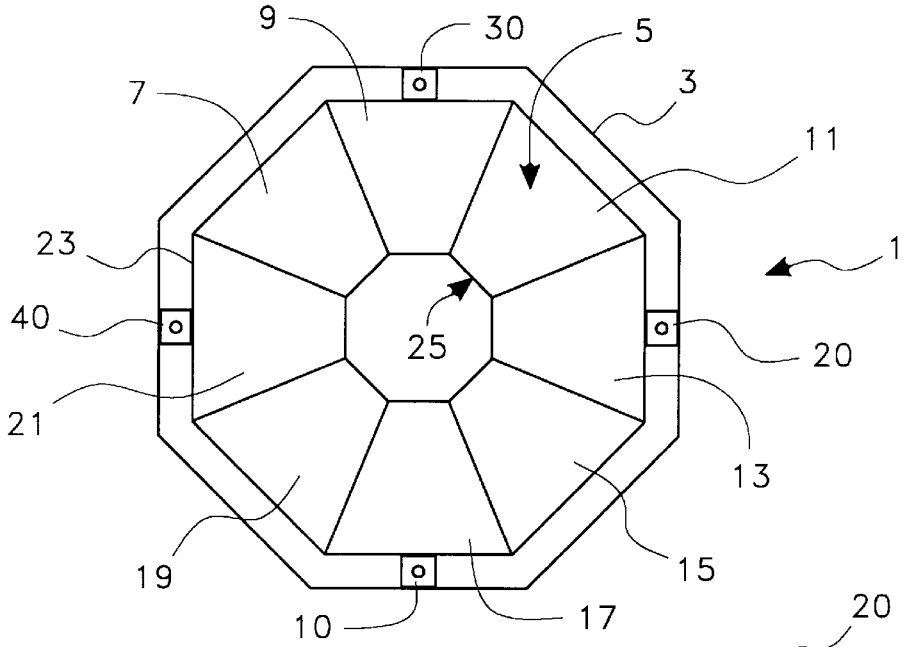
FIG. 1 shows a front view of one preferred embodiment waveguide of the present invention.

As mentioned above, the waveguide of the present invention has unique geometric characteristics. It is a full range waveguide which may be used with circular or other speaker cones is particularly effective with speaker cones and having arcuated segments as described in U.S. Pat. No. 4,881,617 to the inventor herein dated Nov. 21, 1989.

The present invention waveguide has an even number of segments with inside wall surfaces which are flat. By "flat" is meant that each inside wall of the segments has one dimension which is linear. These segments flare outwardly as to width and bend outwardly relative to a central axis along the center of the length of the waveguide. There are at least four segments. Preferably there are four to twenty segments to each waveguide and more preferably eight to eighteen segments. The segment inside walls, and the waveguide itself has a speaker end, that is, the end where the speaker's attached and an open end, the end furthest away from the speaker attachment location.

The present invention waveguide may be viewed as having an overall length which can be divided into two length portions, a lower length which is closer to the speaker end and hereinafter referred to as the "speaker end length" and an outer length which begins at the end of the speaker end length and terminates at the open end, hereinafter referred to as the "open end length". The speaker end length, $L_1$ is measured as a straight line by connecting the beginning point of a segment inside wall to a predetermined point in the arcing wall as viewed from a side view. The open end length, $L_2$, is a straight line measurement taken from the end of the speaker end length to the top or open end of the waveguide. The overall length, $L_3$, is the straight line length measured from the speaker end to the open end. All of these lengths are measured from a side view of a segment.

In the present invention waveguides, the speaker end length of each segment is based in part on the weight of a speaker cone, $w_s$, to be employed as well as the cross-sectional area of the speaker end of the waveguide itself, $A_{SE}$. Thus, the minimum speaker end length is 0.7 times the speaker weight divided by the mass of air (0.0012 grams per cubic centimeters) times one over the cross-sectional area of the speaker end. The maximum speaker end length is utilizing the same formula but instead of 0.7 as the multiplier, 1.2 is the multiplier. In preferred embodiments, the maximum multiplier is 1.0.

The open length is within the range of 0.7 to 1.3 times the speaker end length. It is typically about equal to the speaker end length but shorter or longer lengths may be used without exceeding the scope of the present invention. In any event, $L_2$ should be at least half of the length of $L_1$ or greater.

There is an angle between the straight line length of the lower portion of the segment wall surface and a center line running down the center of the length of the waveguide, referred to as ∠A, which is no greater than 15°. There is also a straight line length of the entire segment wall forming an angle with a center line running down the center of the length of the waveguide, referred to as ∠B, which is within the range determined by the following formulas, ∠B minimum=1.5×∠A and ∠B maximum=2.5×∠A. Typically, angle A is no greater than 12° and angle B is about 1.8 to 2.2 times angle A. In most preferred embodiments angle B is approximately twice angle A.

The present invention waveguide is uniquely formed of molded foam plastic and has essential hardware therewith. In other words, minimally, there is a speaker plate which includes anchoring inserts which are foamed in place during the waveguide body formation. Additional hardware, such as cover attachment means may likewise be embedded in the waveguide body during its formation. The waveguide body may be formed of any known foam plastic and polyurethane foams are preferred. Semi-closed and closed cell foams of this type are commercially available and may be mixed in liquid form and poured into a mold to form a waveguide device of the present invention.

Figure 2B:
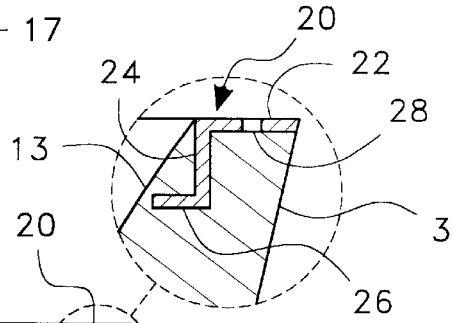
FIG. 2B shows a blow up of one corner of the speaker shown in FIG. 2A.
Figure 2A:
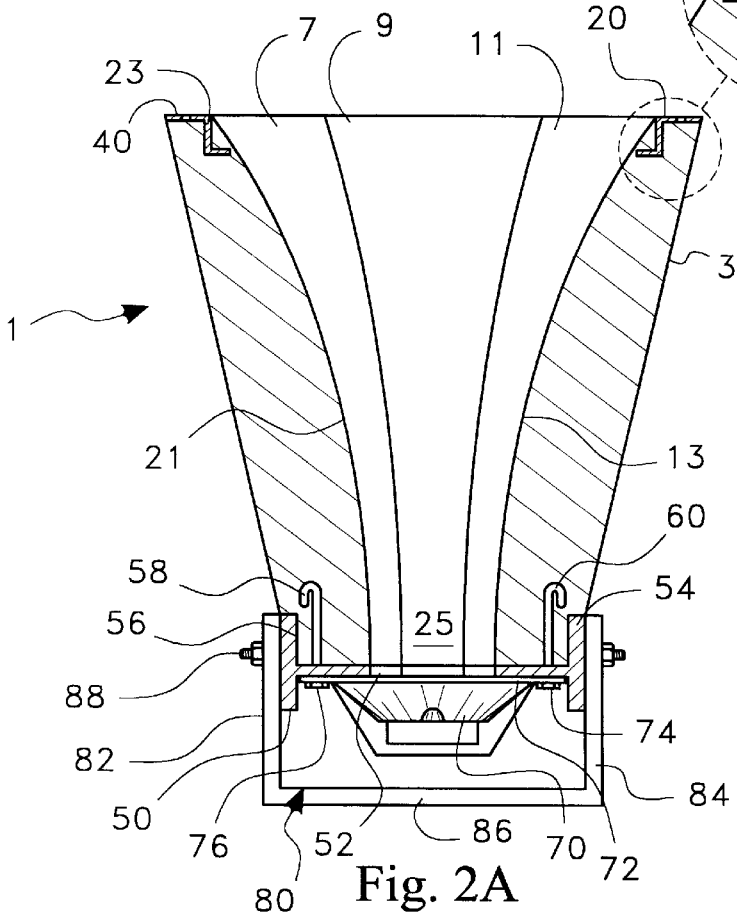
FIG. 2A shows a side cut view thereof, including the details of the speaker plate.
Figure 2C:
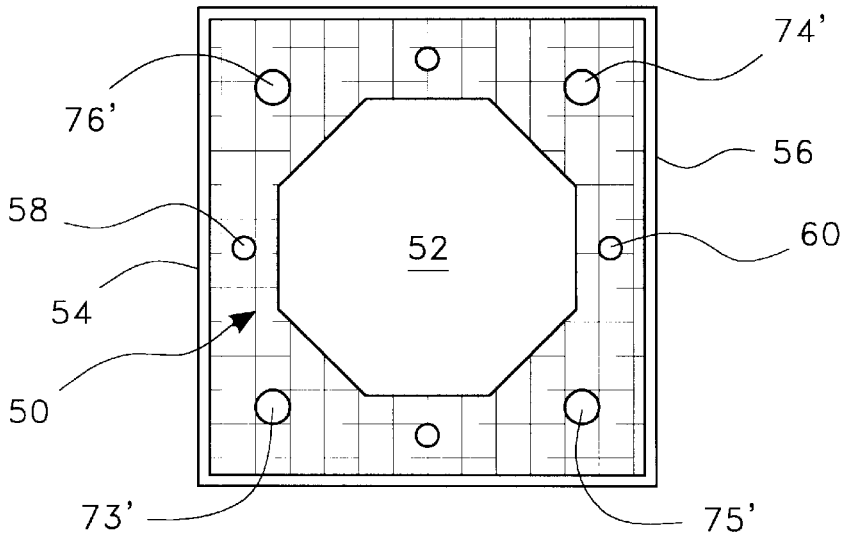
FIG. 2C illustrates a top view of the speaker plate shown in FIG. 2A.

FIG. 1 shows a front view and FIG. 2A shows a side cut view thereof, including the details of the speaker plate, FIG. 2B shows a blow up of one corner of the speaker shown in FIG. 2A and FIG. 2C illustrates a top view of the speaker plate shown in FIG. 2A. Identical parts identically numbered.

FIG. 1 shows waveguide body 1 having an outside octagonal wall 3. The exact configuration of the outside octagonal wall 3 is not critical to the present invention. What is critical, is the shape of the inside wall 5, hereinafter referred to as segments, there are eight segments, namely, segments 7, 9, 11, 13, 15, 17, 19 and 21. There is a top open end 23 and a bottom speaker end 25. Hereinafter these will be referred to as the open end and the speaker end respectively. At top open end 23 there are shown four cover attachment means 10, 20, 30 and 40. These may be used for attaching any structure to the open end of the cone which would not affect the functionality of the waveguide device, such as a formed cloth cover, advertising banners, etc.

As shown in FIG. 2A the side cut view of waveguide body 1 of FIG. 1 shows that the speaker end 25 has a much smaller opening than the top open end 23, that the segments flare outwardly from speaker end to open end and thereby increase in width from speaker end to open end. At the speaker end 25 is shown a side cut view of end plate 50 for mounting of speaker 70. End plate 50 includes anchoring means 58 and 60 which have been welded to its bottom and have been embedded in the foam waveguide body 1 during molding. End plate 50 also has a series of holes for screwing of speaker 70 (and its cover) thereto or bolting thereto such as with bolts 74 and 76 which pass through flange 72 of speaker 70. Note that end plate 50 has side walls 54 and 56 and sound opening 52 for sound transmission from speaker 70 through waveguide body 1. Although the top portion of waveguide body 1 shows an octagonal outside and inside shape, the speaker end 25 also has an octagonal inside shape, but the outside tapers into a square. The outside shape is not critical to the sound function, but is structurally easy to work with. FIG. 2C shows a top view of end plate 50 with identical parts identically numbered. In this case there are four attachment holes for bolts shown as 73', 74', 75' and 76'.

Referring again back to FIG. 2A, there is a U-shaped bracket 80 which has side walls 82 and 84 bolted to end plate 50 via threaded rods and bolts such as rod 88. Bracket 80 includes additional holes drilled therethrough (not shown) for attachment to a wall, a pole or other fixture.

Figure 3:
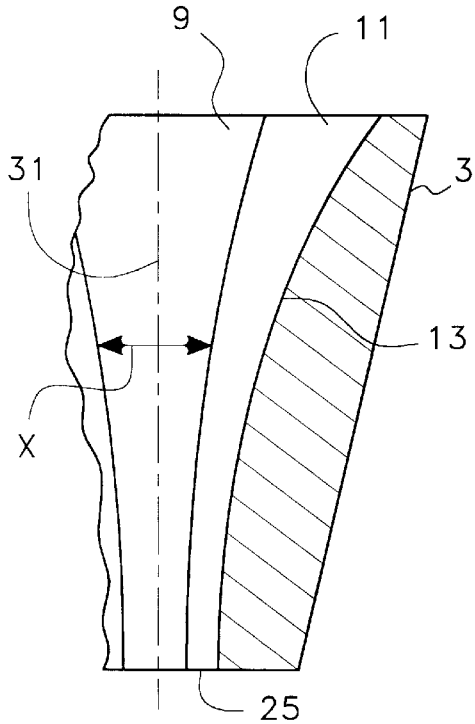
FIG. 3 illustrates a partial cut side view of the FIG. 2 waveguide with the hardware removed, with critical parameters illustrated.

FIG. 3 shows a partial repeat view of FIG. 2 with identical parts identically numbered but with the hardware removed for ease of illustration and illustrates a central axis 31 about which all of the waveguide segments are symmetrically related to one another, i.e. opposite segments are mirror images of one another. With line x is shown to further illustrate the increasing width of each segment, such as segment 9 and to also illustrate that if line x were taken parallel to the speaker end anywhere along segment 9, it would be a flat line.

Figure 4:
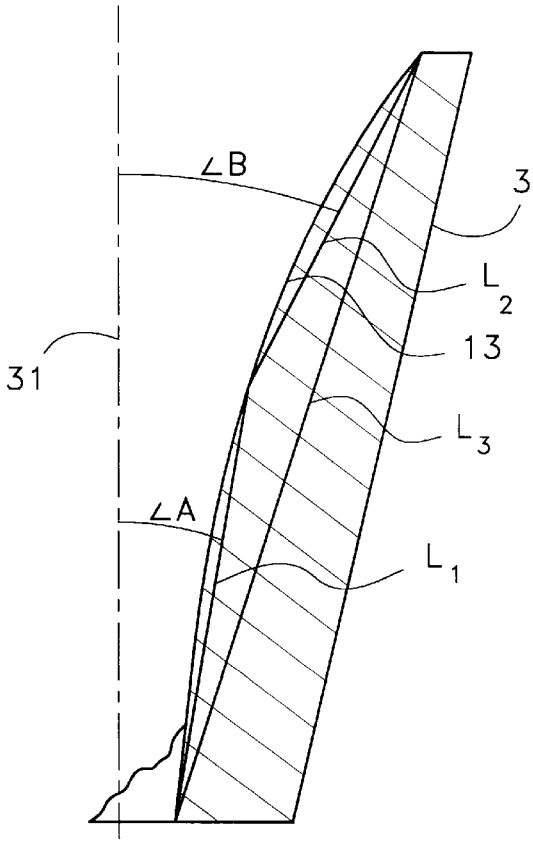
FIG. 4 shows a side cut view of a segment of the present invention waveguide shown in FIG. 3.

FIG. 4 shows cut side view segment 13 of the hardware-free waveguide body 1 of FIG. 3 and illustrates ∠A and ∠B relative to center line 31 (these angles are defined in more detail above). Speaker end length $L_1$, is illustrated in conjunction with ∠A and relative to segment 13 inside wall, as is open end length $L_2$ and ∠B. Overall straight line length $L_3$ is also illustrated.

Figures 5, 6:
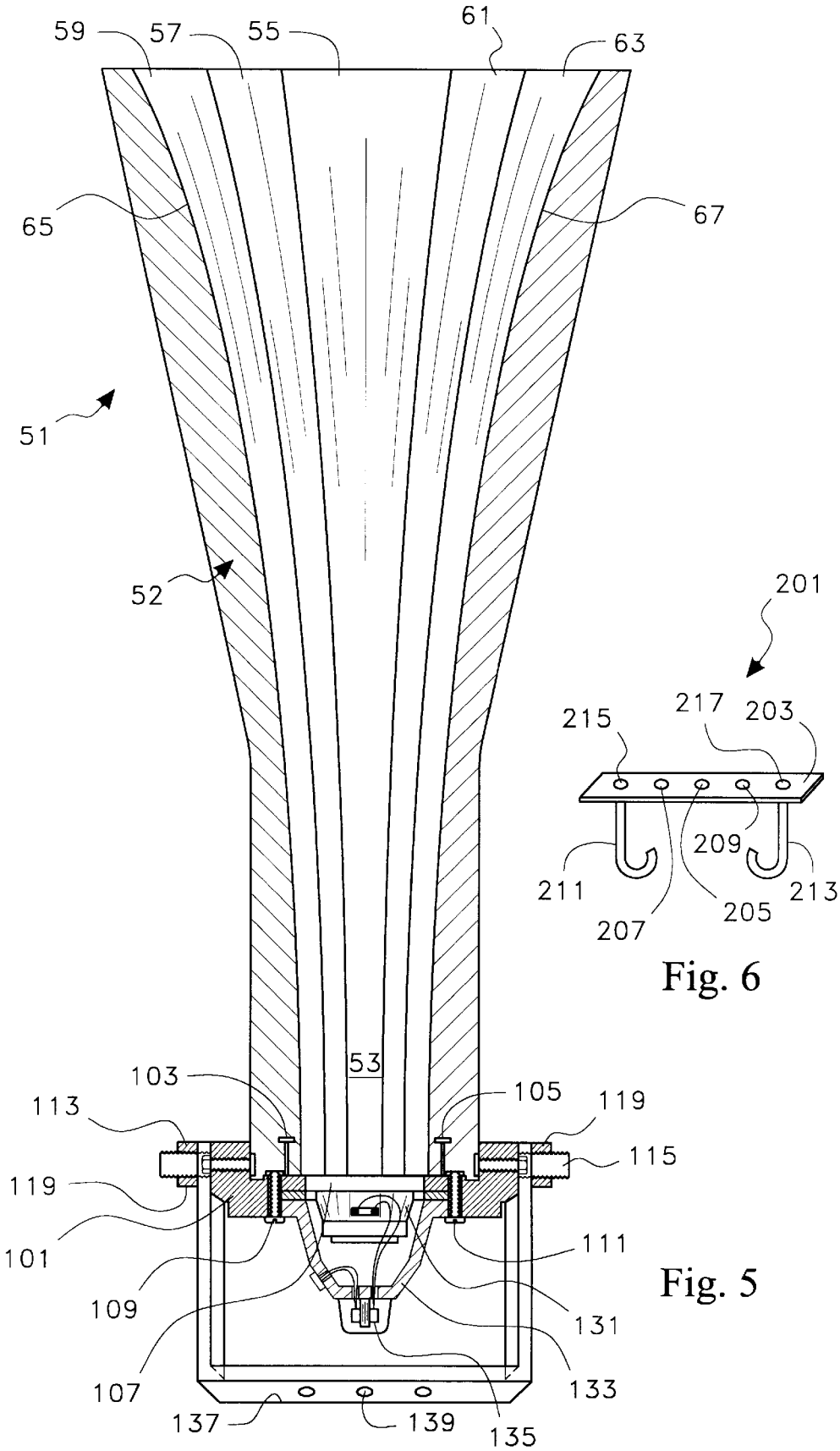
FIG. 5 shows a cut side view of an alternative waveguide device of the present invention; and, FIG. 6 shows an oblique side view of an alternative embodiment cover attachment means.

FIG. 5 shows a side cut view of another present invention waveguide 51 having a waveguide body 52 which has a much longer overall length and narrower angles but conforms to the formula set forth above. Waveguide 51 has a total of twelve segments and in this case because it is shown in a cut sectional view, it illustrates five whole segments, such as segments 55, 57, 59, 61 and 63 plus two half segments in their side view, segments 67 and 69. This waveguide may be formed of foam and have a skinned surface similar to the construction described above and further includes and end plate 101 with anchors such as anchors 103 and 105, which are embedded in the foam structure of waveguide body 52 during its formation at speaker end 53. End plate 101 also has an opening 107 and has attached thereto speaker 131 with transformer 135 connected thereto. Also included is bracket 137 with mounting orifices such as orifice 139 for attachment to a fixture. End plate 101 is connected to speaker 131 and transformer bracket 133 with screws such as screws 109 and 111. Additionally, bolts 113 and 115 with nuts 117 and 119 affix bracket 137 to end plate 101 and may be loosened and swiveled to adjust the angle of device 51 relative to a fixture to which it may be attached. One embodiment of the specific characteristics of a waveguide shown in FIG. 5 is discussed below in detail in conjunction with Example 3.

FIG. 6 illustrates an oblique side view of an alternative embodiment cover attachment means which may be used at the open end of waveguide devices of the present invention. Thus, cover attachment means 201 has a flat plate 203 which may have a length approximately equal to the open end of a waveguide segment to replace, for example, cover attachment means 20 shown in FIG. 1. Plate 203 includes three separate screw holes 205, 207 and 209 and two J-rods 211 and 213, each being welded at welds 215 and 217 respectively. These J-rods are used to anchor cover attachment means 201 into a waveguide body during its foaming formation. Other types of brackets and attachment means may also be used without exceeding the scope of the present invention.

EXAMPLE 1

A 40°×40° waveguide of the present invention contains eight equal segments such as is illustrated in FIGS. 1 through 4. The overall length of the speaker as measured in a straight line is approximately 26 inches. The speaker end has a cross-sectional opening of 6.8 inches and the speaker end length, $L_1$, is approximately 13.5 inches and has an angle ∠A of 10°. The open end length, $L_2$, is approximately 14 inches and has an angle ∠B of 20°. The open end has a cross-sectional opening of about 21.5 inches. The total speaker straight line length is approximately 25.7 inches. This 40°×40° waveguide (40° total angle of opening at open end taking two measurements at right angles to one another) is constructed of polyurethane foam with a urethane skin coating. Attached to a speaker of the U.S. Pat. No. 4,881,617, Faraone speaker, with arcuated segments, the waveguide provides excellent full range projection with minimal distortion.

EXAMPLE 2

A 40°×40° cone is constructed in accordance with Example 1 but utilizing sixteen segments instead of eight.

The waveguide is constructed of foam with integral skin and includes mounting brackets embedded therein for speaker support and attachment.

EXAMPLE 3

Another, elongated, present invention waveguide of the type set forth in FIG. 5, is constructed with twelve segments and has a total length of about 27 inches. Its speaker end has a cross-sectional opening of 2.8 inches and an open end cross-sectional opening of about 9 inches. ∠A is 5° and ∠B is 12°. The open end thus has a 24°×24° opening. This waveguide has no angle change for the lower half of the $L_1$ portion of each segment, and then the angle increases from 0° to 5° over the remaining length of that $L_1$ portion of each segment. Thus, about ¼ of the total length of the waveguide toward its speaker end is of constant cross-section.

Obviously, numerous modifications and variations of the present invention are possible in light of the above teachings. It is therefore understood that within the scope of the appended claims, the invention may be practiced otherwise than as specifically described herein.

What is claimed is:

1. A waveguide device for an acoustic speaker having a predetermined cone weight, which comprises:

a waveguide body having a speaker end and an open end and having a plurality of segments, said segments being substantially similar to one another, there being an even number of segments from four to twenty each of said segments having a flat surface in a plane parallel to said speaker end, each of said segments having inside wall surfaces which flare increasingly outwardly from said speaker, and wherein each of said segments' inside wall surfaces has a speaker end length, $L_1$, which is within the range determined by the following formulas:

$$L_1 \text{ minimum}=0.7\times w_s/0.0012 \text{ g/cm}^3\times 1/A_{SE}$$

and $$L_1 \text{ maximum}=1.2\times w_s/0.0012 \text{ g/cm}^3\times 1/A_{SE}$$

wherein $L_1$ is a straight line length of the lower portion of the segment wall surface, referred to as the speaker end length, $w_s$ is the weight of a speaker cone in grams/cm$^3$, and $A_{SE}$ is the cross-sectional area of the speaker end in square centimeters;

further wherein each of said segment inside wall surfaces have an outer length $L_2$ which is at least 0.5 times $L_1$;

further wherein the angle between the straight line length of the lower portion of the segment wall surface and a center line running down the center of the length of the waveguide, referred to as ∠A is no greater than 15° and wherein the straight line length of the entire segment wall and a center line running down the center of the length of the waveguide referred to as ∠B is within the range determined by the following formulas:

$$\angle B \text{ minimum}=1.5\times\angle A$$

and $$\angle B \text{ maximum}=2.5\times\angle A;$$

further wherein said waveguide body is formed of molded, foamed plastic and said waveguide device includes at its speaker end:

an end plate having a speaker face, having anchoring inserts, and having means for attachment of a speaker thereto, said anchoring inserts being securely embedded into said speaker end of said waveguide body.

2. The waveguide device of claim 1 wherein said waveguide device further includes a plurality of cover attachment means, said means including an attachment end and an anchoring insert, said anchoring insert being securely embedded into said open end of said waveguide body.

3. The waveguide device of claim 1 wherein there are between eight and eighteen segments forming said waveguide.

4. The waveguide device of claim 1 wherein $L_2$ has a length within the range determined by the following formulas:

$$L_2 \text{ minimum}=0.7\times L_1$$

and $$L_2 \text{ maximum}=1.3\times L_1.$$

5. The waveguide device of claim 2 wherein $L_2$ has a length within the range determined by the following formulas:

$$L_2 \text{ minimum}=0.7\times L_1$$

and $$L_2 \text{ maximum}=1.3\times L_1.$$

6. The waveguide device of claim 3 wherein $L_2$ has a length within the range determined by the following formulas:

$$L_2 \text{ minimum}=0.7\times L_1$$

and $$L_2 \text{ maximum}=1.3\times L_1.$$

7. The waveguide device of claim 1 wherein said ∠A is no greater than 12°.

8. The waveguide device of claim 1 wherein $L_1$ is within the range determined by claim 1, the formulas for its minimum length, and has a maximum length determined by the formula:

$$L_2 \text{ maximum}=w_s/0.0012 \text{ g/cm}^3\times 1/A_{SE}.$$

9. The waveguide device of claim 2 wherein $L_1$ is within the range determined by claim 1, the formulas for its minimum length, and has a maximum length determined by the formula:

$$L_2 \text{ maximum}=w_s/0.0012 \text{ g/cm}^3\times 1/A_{SE}.$$

10. The waveguide device of claim 3 wherein $L_1$ is within the range determined by claim 1, the formulas for its minimum length, and has a maximum length determined by the formula:

$$L_2 \text{ maximum}=w_s/0.0012 \text{ g/cm}^3\times 1/A_{SE}.$$

11. The waveguide device of claim 7 wherein $L_1$ is within the range determined by claim 1, the formulas for its minimum length, and has a maximum length determined by the formula:

$$L_2 \text{ maximum}=w_s/0.0012 \text{ g/cm}^3\times 1/A_{SE}.$$

12. The waveguide device of claim 1 wherein said waveguide device further includes a U-shaped bracket connected to at least one of said end plate and said waveguide body and having attachment means for attaching said waveguide device to a fixture.

13. The waveguide device of claim 2 wherein said waveguide device further includes a U-shaped bracket connected to at least one of said end plate and said waveguide body and having attachment means for attaching said waveguide device to a fixture.

14. The waveguide device of claim 3 wherein said waveguide device further includes a U-shaped bracket connected to at least one of said end plate and said waveguide body and having attachment means for attaching said waveguide device to a fixture.

15. The waveguide device of claim 12 wherein said U-shaped bracket is located relative to said end plate so as to provide sufficient space therebetween for installation and removal of a speaker.

16. The waveguide device of claim 13 wherein said U-shaped bracket is located relative to said end plate so as to provide sufficient space therebetween for installation and removal of a speaker.

17. The waveguide device of claim 14 wherein said U-shaped bracket is located relative to said end plate so as to provide sufficient space therebetween for installation and removal of a speaker.

18. The waveguide device of claim 1 wherein said ∠B is within the range determined by the formulas:

$$\angle B \text{ minimum} = 1.8 \times \angle A$$

and $$\angle B \text{ maximum} = 2.2 \times \angle A.$$

19. The waveguide device of claim 2 wherein said ∠B is within the range determined by the formulas:

$$\angle B \text{ minimum} = 1.8 \times \angle A$$

and $$\angle B \text{ maximum} = 2.2 \times \angle A.$$

20. The waveguide device of claim 3 wherein said ∠B is within the range determined by the formulas:

$$\angle B \text{ minimum} = 1.8 \times \angle A$$

and $$\angle B \text{ maximum} = 2.2 \times \angle A.$$

* * * * *